US006568329B1

(12) United States Patent
Robinson

(10) Patent No.: US 6,568,329 B1
(45) Date of Patent: May 27, 2003

(54) MICROELECTROMECHANICAL SYSTEM (MEMS) SAFE AND ARM APPARATUS

(75) Inventor: Charles H. Robinson, Silver Spring, MD (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 10/065,240

(22) Filed: Sep. 27, 2002

(51) Int. Cl.[7] ..... F42L 15/00; F42L 15/22; F42L 15/24; F42L 15/26; F42L 15/34

(52) U.S. Cl. ..... 102/231; 102/221; 102/222; 102/232; 102/235; 102/237; 102/238; 102/244; 102/247; 102/248; 102/251; 102/254; 102/255; 102/256

(58) Field of Search ..... 102/221, 222, 102/231, 232, 235, 237, 238, 244, 247, 248, 251, 254, 255, 256

(56) References Cited

U.S. PATENT DOCUMENTS 3,786,759 A * 1/1974 Mellen et al. ..... 102/71
3,985,079 A * 10/1976 Post et al. ..... 102/80
4,815,381 A * 3/1989 Bullard ..... 102/247
4,986,184 A * 1/1991 Kude ..... 102/256
5,275,107 A * 1/1994 Weber et al. ..... 102/251
5,693,906 A * 12/1997 Van Sloun ..... 102/251
5,705,767 A * 1/1998 Robinson ..... 102/231
6,167,809 B1 * 1/2001 Robinson et al. ..... 102/235
6,308,631 B1 * 10/2001 Smith et al. ..... 102/254
6,321,654 B1 * 11/2001 Robinson ..... 102/251

* cited by examiner

*Primary Examiner*—Michael J. Carone
*Assistant Examiner*—H. A. Blackner
(74) *Attorney, Agent, or Firm*—John F. Moran

(57) ABSTRACT

A MEMS type safe and arm apparatus for a fuze includes a setback slider responsive to a first setback acceleration, the setback slider moving linearly in response to the first setback acceleration; a setforward slider responsive to a first setforward acceleration, the setback slider unlocking the setforward slider, the setforward slider moving linearly in response to the first setforward acceleration; a first rotor responsive to a second setback acceleration, the setforward slider unlocking the first rotor, the first rotor rotating in response to the second setback acceleration; a second rotor responsive to a second setforward acceleration, the first rotor unlocking the second rotor, the second rotor rotating in response to the second setforward acceleration; and an arming slider that moves linearly in response to the rotation of the second rotor to thereby arm the fuze.

16 Claims, 1 Drawing Sheet

MICROELECTROMECHANICAL SYSTEM (MEMS) SAFE AND ARM APPARATUS

FEDERAL RESEARCH STATEMENT

The inventions described herein may be manufactured, used licensed by or for the U.S. Government for U.S. Government purposes.

BACKGROUND OF INVENTION

The invention relates in general to safe and arm devices and in particular to MEMS (microelectromechanical systems) safe and arm devices.

A persistent goal in safe and arm devices for munitions is to reduce their volume, cost and weight. Reduced volume and weight provides increased space for warheads (enhanced lethality) and also reduces the soldier's load. The reduction in cost increases overall system affordability. The present invention exploits the advanced manufacturing techniques and materials of MEMS technology to miniaturize fuze safety and arming functions.

U.S. Pat. Nos. 6,321,654; 6,167,809; and 5,705,767 disclose devices related to the instant invention and are hereby expressly incorporated by reference.

SUMMARY OF INVENTION

The present invention is an inertially operated MEMS mechanical safety and arming device for munitions. Compared to prior art safe and arm devices, the instant invention achieves as much as a 75% reduction in volume and a 50% reduction in cost. The MEMS-based safe and arm device is fabricated using lithographic techniques known in the microelectronics industry. The features of the MEMS safe and arm device combine both "sense" and "actuate" functions in a single, inertially actuated "mechanical logic" chip that mechanically arms the fuze by moving a microscale initiator in-line with other fire train components. In addition, by shrinking the mechanical safe and arm components and associated firetrain, the invention achieves an environmental advantage by eliminating up to 90% of the lead used in prior art devices.

The invention will be better understood, and further objects, features, and advantages thereof will become more apparent from the following description of the preferred embodiments, taken in conjunction with the accompanying drawings.

BRIEF DESCRIPTION OF DRAWINGS

In the drawings, which are not necessarily to scale, like or corresponding parts are denoted by like or corresponding reference numerals.

DETAILED DESCRIPTION

Figure 1:
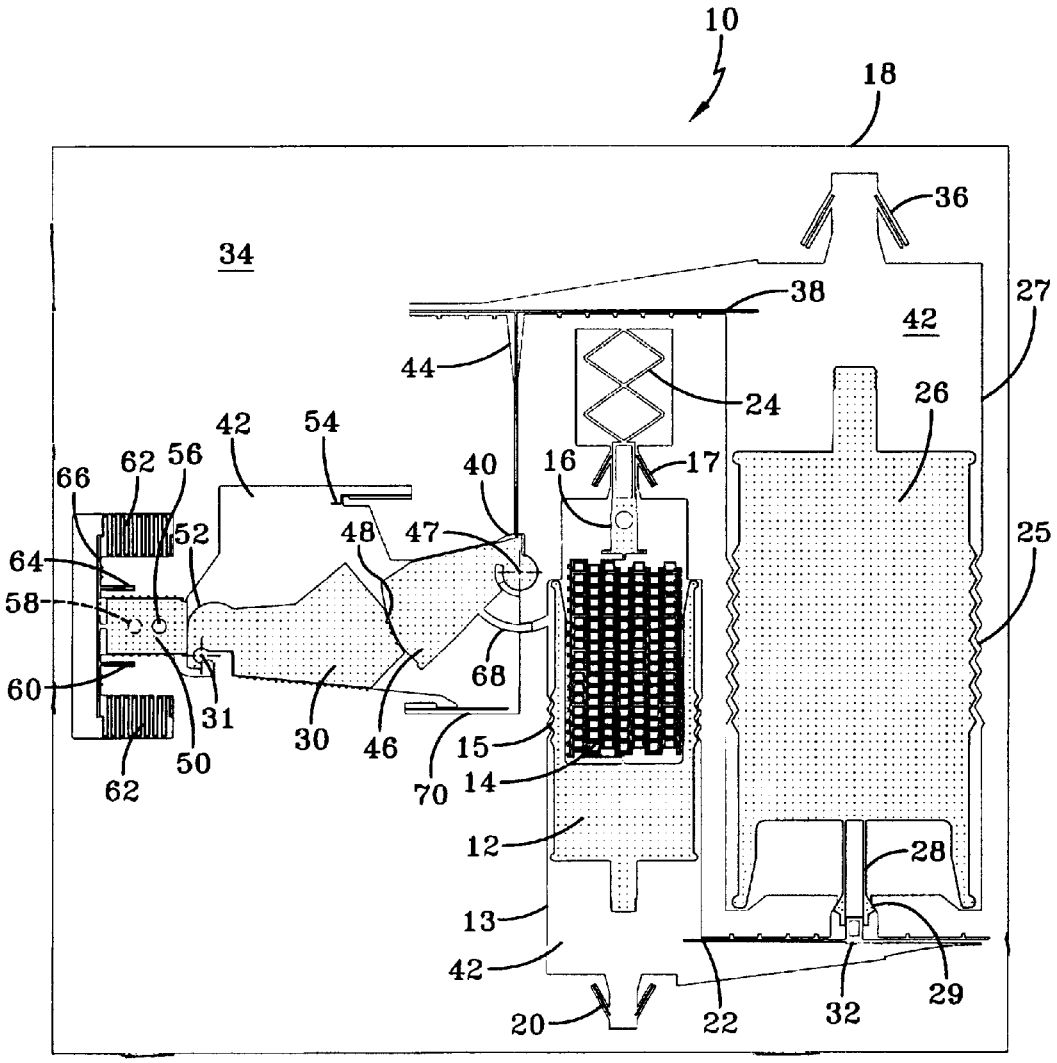
FIG. 1 is a plan view of one embodiment of the invention.

The primary function of the present invention is as a mechanical safe and arm device for a munition. In particular, it is suitable for use as the mechanical safe and arm for a submunition, such as the XM-80 submunition grenade, aboard an artillery round, such as an extended range guided munition (ERGM) cargo round. The cargo round typically carries a plurality of submunitions. The cargo round includes a gas generator for expelling the submunitions from the round.

The present invention is responsive to four distinct acceleration forces that develop during the flight of the cargo round. The cargo round is generally launched or fired from a tube, such as an artillery piece. The initial acceleration in the tube is referred to as the "first setback acceleration." After exiting the launch tube, the cargo round decelerates due to atmospheric drag forces. This deceleration is referred to as the "first setforward acceleration." When the gas generator is initiated the submunition (s) are thrust forward against the forward bulkhead. The forward thrust of the submunition results in a "second setback acceleration." The impact of the submunition against the forward bulkhead is a deceleration referred to as "the second setforward acceleration."

With reference to FIG. 1, the inventive safe and arm device 10 is constructed on a die 18 that includes land areas 34 and well areas 42. The moveable components of the invention are disposed in the well areas 42. The components of the invention are fabricated using a suitable microfabrication technology, for example, MEMS. The components have vertical or nearly vertical sides (i.e., substantially perpendicular to the plan view of FIG. 1) that interact laterally on the substrate.

Safe and arm device 10 includes set back slider 12 with biasable reset spring 14, end-of-travel latching socket 20, spring bias head 16, spring bias head locking socket 17 and spring 24 anchored to die 18. Device 10 further includes setforward slider 26 with anchor legs 28, linchpin 32, anchor linchpin release lever 22, end-of-travel latching socket 36, actuable lever 38, catch pin 44, rotor 46, curved pin interlock 68, end-of travel locking catch 70, rotor 30 with motion check at interface 48 with rotor 46, curved surface (cam action) 52 on rotor 30 against arming slider 50, end-of-travel locking catch 54, arming slider 50 with initiating pyrotechnic or energetic material 56, a pair of resistance springs 62, "armed" standoff latches 64, spring arm 66, and pins 60.

Spring 14 is tensioned when spring bias head 16 is manipulated upwards to latch in spring bias head locking socket 17. Anchor spring 24 connected to spring bias head 16 yields in bending to permit the movement. The arming slider 50 is loaded with suitable explosive or energetic material 56. FIG. 1 shows the arming slider 50 in the unarmed position. The conclusion of arming occurs when arming slider 50 moves to the left (energetic material 56 moves to location 58) and is latched there.

The rotating and sliding elements are held in-plane by a cover plate (not shown). The cover plate covers the open die 18 while allowing enough clearance to permit the sliders and rotors to move freely without binding.

Inertial inputs to the device 10, in the plane of die 18, create forces on the sliders and rotors. The spring 14 and setback slider 12 are preferably designed such that an acceleration pulse whose delta V>40 foot drop (approx. 50 fps) is able to make the slider 12 move downward and trip lever 22. During launch/firing of the cargo round, the forces (first setback acceleration) develop on setback slider 12 which moves down the slider track 13, hits lever 22 and hauls lever 22 downward. This action pulls linchpin 32 out from between anchor legs 28. The setback slider 12 latches in latching socket 20. The setback slider 12 and slider track 13 may also include a zigzag delay structure 15 to increase the length of time required for the setback slider 12 to move.

The first setforward acceleration moves setforward slider 26 upward, as oriented in FIG. 1. When the first setforward acceleration is sufficiently large, anchor legs 28 are forced together by the inclines 29 they pull against, until finally the anchor legs 28 pull through the constriction and free setforward slider 26 to move upwards. Anchor legs 28 are prevented from pulling through by linchpin 32, so long as linchpin 32 is inserted between them. The first setforward acceleration forces push setforward slider 26 along its track 27 (a zigzag delay structure 25 may also be included). Setforward slider 26 continues until it hits lever 38. The continuing movement of slider 26 lifts lever 38 upwards. Slider 26 latches in latching socket 36. The upward movement of lever 38 lifts catch pin 44 upwards to clear its interposition against the checktab 40 of rotor 46.

The gas generator exerts a large (approximately 10,000 G) acceleration on the payload (munition), moving it forward. This is the second setback acceleration, and it causes rotor 46, now free to move by the withdrawal of catchpin 44 at checktab 40, to rotate CCW until it stops, or about 45 degrees movement. The center of rotation of rotor 46 is at 47. At its end of travel, rotor 46 is locked in place by locking catch 70. When rotor 46 moves, it provides an out-of-sequence check by inserting curved pin interlock 68 towards setback slider 12. If slider 12 has not moved from its starting position, rotor 46 is prevented from rotating fully to its catch position. Additionally, rotor 30 is not permitted to actuate arming slider 50 because of the interference of rotor 30 with rotor 46.

The impact of the submunition against the forward bulkhead creates the second setforward acceleration that rotates rotor 30. Rotor 30 is now cleared of the lock-out interference from rotor 46. Rotor 30 rotates CCW to its stops. As it rotates, rotor 30 exerts a lateral force by cam action of curved surface 52 against arming slider 50. At its end of travel, rotor 30 latches in its up position against locking catch 54. Rotor 30 rotates about 50 degrees CCW from its starting position around a center of rotation 31. Arming slider 50 is pushed left by the cam action of curved surface 52 of rotor 30. The motion of arming slider 50 to the left is resisted by friction and by springs 62.

Springs 62 are connected to spring arm 66 which is connected to arming slider 50. When rotor 30 has rotated about 50 degrees CCW, arming slider 50 has positioned the energetic material 56 at position 58. Position 58 is in line with downstream pyrotechnics or other intended acceptors. Pins 60 are connected to spring arm 66 and are pulled out of standoff latches 64 by movement of arming slider 50. Once the pins 60 pull out of standoff latches 64, the standoff latches 64 maintain the arming slider 50 in the armed position, even if rotor 30 comes loose from its locking catch 54. The MEMS mechanical safe and arm device 10 is now armed.

While the invention has been described with reference to certain preferred embodiments, numerous changes, alterations and modifications to the described embodiments are possible without departing from the spirit and scope of the invention as defined in the appended claims, and equivalents thereof.

What is claimed is:

1. A MEMS type safe and arm apparatus for a fuze, the apparatus being constructed on a die and comprising:

a setback slider responsive to a first setback acceleration, the setback slider moving linearly in response to the first setback acceleration;

a setforward slider responsive to a first setforward acceleration, the setback slider unlocking the setforward slider, the setforward slider moving linearly in response to the first setforward acceleration;

a first rotor responsive to a second setback acceleration, the setforward slider unlocking the first rotor, the first rotor rotating in response to the second setback acceleration;

a second rotor responsive to a second setforward acceleration, the first rotor unlocking the second rotor, the second rotor rotating in response to the second setforward acceleration; and an arming slider that moves linearly in response to the rotation of the second rotor to thereby arm the fuze.

2. The apparatus of claim 1 further comprising a reset spring connected to the setback slider, a spring bias head connected to the reset spring, a spring bias head locking socket and a second spring connected at one end to the spring bias head and at another end to the die.

3. The apparatus of claim 2 further comprising a first latching socket for receiving and locking the setback slider in place.

4. The apparatus of claim 3 wherein the setback slider includes a zigzag delay structure.

5. The apparatus of claim 1 wherein the setforward slider includes anchor legs, the apparatus further comprising a first lever and a linchpin, the first lever being connected to the linchpin, the linchpin locking the anchor legs of the setforward slider wherein, during its linear motion, the setback slider moves the first lever which moves the linchpin to unlock the anchor legs of the setforward slider.

6. The apparatus of claim 5 further comprising a second latching socket for receiving and locking the setforward slider in place.

7. The apparatus of claim 6 wherein the setforward slider includes a zigzag delay structure.

8. The apparatus of claim 1 further comprising a second lever and a catch pin, the catch pin being connected to the second lever, the catch pin locking the first rotor wherein, during its linear motion, the setforward slider moves the second lever which moves the catch pin to unlock the first rotor.

9. The apparatus of claim 1 further comprising a locking catch for locking the first rotor after rotation of the first rotor.

10. The apparatus of claim 1 wherein the first rotor further comprises a curved pin interlock for preventing rotation of the first rotor by interference with the setback slider, if the setback slider has not completed its linear motion.

11. The apparatus of claim 1 wherein the first rotor engages the second rotor to prevent rotation of the second rotor and wherein the first rotor disengages the second rotor when the first rotor rotates.

12. The apparatus of claim 1 further comprising a locking catch to lock the second rotor after its rotation.

13. The apparatus of claim 1 wherein the second rotor includes a curved surface which contacts and moves the arming slider linearly from an unarmed position to an armed position when the second rotor rotates.

14. The apparatus of claim 13 wherein the arming slider includes energetic material disposed thereon wherein the energetic material arms the fuze when the arming slider is in the armed position.

15. The apparatus of claim 1 further comprising a pair of springs, a spring arm connecting the pair of springs, the spring arm being connected to an end of the arming slider to thereby resist movement of the arming slider from the unarmed to the armed position.

16. The apparatus of claim 15 wherein the spring arm further comprises a pair of pins, the apparatus further comprising a pair of standoff latches, one standoff latch disposed on either side of the arming slider, the pair of pins being disposed in the pair of standoff latches when the arming slider is in the unarmed position wherein when the arming slider is in the armed position, the pins are removed from the standoff latches and the standoff latches prevent the pins from reentering the standoff latches, thereby preventing the arming slider from returning to the unarmed position.

* * * * *